US007513800B2

(12) United States Patent
Nolting et al.

(10) Patent No.: US 7,513,800 B2
(45) Date of Patent: Apr. 7, 2009

(54) ELECTRICAL CONNECTING AND SWITCHING ARRANGEMENT

(75) Inventors: Reinhard Nolting, Detmold (DE); Marco Waldhoff, Sandebeck (DE); Wolfgang Schild, Herford (DE); Klaus Püschner, Detmold (DE); Walter Hanning, Detmold (DE); Volker Schröder, Lemgo (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/821,827

(22) Filed: Jun. 26, 2007

(65) Prior Publication Data

US 2008/0014799 A1 Jan. 17, 2008

(30) Foreign Application Priority Data

Jun. 27, 2006 (DE) ..... 20 2006 010 091 U

(51) Int. Cl.
*H01R 13/66* (2006.01)

(52) U.S. Cl. ..... 439/620.15

(58) Field of Classification Search ..... 439/620.15, 439/395, 707, 709, 715–717
See application file for complete search history.

(56) References Cited

U.S. PATENT DOCUMENTS 4,020,301 A * 4/1977 Ericson et al. ..... 200/50.26
5,295,870 A * 3/1994 Rei et al. ..... 439/717
5,318,461 A * 6/1994 Frikkee et al. ..... 439/715
5,434,369 A 7/1995 Tempco
5,629,831 A * 5/1997 Eggert et al. ..... 361/624
5,658,172 A * 8/1997 Schmidt et al. ..... 439/716
5,691,518 A 11/1997 Jones
5,735,700 A * 4/1998 Hohorst ..... 439/98
6,425,770 B1 * 7/2002 Lostoski et al. ..... 439/76.1
6,506,071 B2 * 1/2003 Lange ..... 439/358
6,848,951 B1 * 2/2005 Bechaz et al. ..... 439/716
7,179,137 B1 * 2/2007 Quendt et al. ..... 439/828
2003/0045178 A1 * 3/2003 Huiskamp et al. ..... 439/709
2003/0139099 A1 * 7/2003 Ude et al. ..... 439/715
2003/0224665 A1 * 12/2003 Neumann et al. ..... 439/638

* cited by examiner

*Primary Examiner*—Jean F Duverne
(74) *Attorney, Agent, or Firm*—Lawrence E. Laubscher, Sr.; Lawrence E. Laubscher, Jr.

(57) ABSTRACT

A terminal block connecting apparatus includes first and second support members displaceable from a disengaged condition toward an engaged condition in which corresponding main terminal blocks are brought into electrical engagement, characterized by the provision of first and second test terminal blocks connected with the support members for electrical engagement when the first and second support members are in an intermediate condition between the disengaged and engaged conditions. One of the test terminal blocks is supported by a carrier member for movement relative to the associated support member, whereby the test terminal blocks will remain in electrical engagement during displacement of the support members between the test and connected conditions. A friction retaining arrangement serves to resist displacement of the carrier member relative to its associated support member.

12 Claims, 9 Drawing Sheets

ELECTRICAL CONNECTING AND SWITCHING ARRANGEMENT

BACKGROUND OF THE INVENTION

1. Field of the Invention

A terminal block connecting apparatus includes first and second support members displaceable from a disengaged condition toward an engaged condition in which corresponding main terminal blocks are brought into electrical engagement, characterized by the provision of first and second test terminal blocks connected with the support members for electrical engagement when the first and second support members are in an intermediate condition between the disengaged and engaged conditions. Carrier means support one of the test terminal blocks for displacement relative to the associated support member, whereby the test terminal blocks remain in electrical engagement during displacement of the support members between the intermediate test condition and the final connected condition. Friction retaining means serve to resist displacement of the carrier member relative to its associated support member.

2. Description of Related Art

It is known in the patented prior art to provide electrical switching and connecting arrangements, such as in the field of emergency power supplies, to connect and disconnect electrical power contacts. In this operation, an additional equipment segment with corresponding power contacts is pushed upon a basic equipment segment with first power contacts. It is known that along with the power contacts, one can connect additional contacts with each other on the equipment segments, which already contact each other in a test position before there is any pushing of the equipment segment into the final engaged position in which the power contacts are also connected with each other. In this way, before reaching the final engaged position, one can already perform tests, for example, to check functions of the equipment segments that are to be connected with each other. In the broadest sense, the invention relates to the area of connecting the additional contacts upon equipment segments that are to be connected with each other by means of suitable switch gears. It is, for example, conceivable that one of the contacts to be connected with each other is fashioned in the form of a sliding contact in which the other contact can be moved out of a first position—the test position—in a sliding manner all the way into the final engaged position (in which the power contacts are connected with each other).

Such switch gears are known from the state of the art. But their structure is often relatively complicated. Besides, the known designs are not always fully functionally reliable.

Against this background, the present invention was developed to provide a switch gear that has a simple design and nevertheless a particularly stable structure by means of which, also in case of strong forces to be included in the wiring, one can reliably and easily attain the required test position as well as the final connected position.

Accordingly, the switch gear has at least one separable locking device for the purpose of locking the switch gear in the first position on the support collar of the electrical appliance, which is so designed that the locked position can be separated only by the shifting of the switch gear by overcoming a friction force between elements of the locking device.

The switch gear of the present invention has a simple structure and can therefore be made at reasonable cost. The locking device is so structured that, first of all, one attains a clearly recognizable locking position. Either in this position or shortly thereafter, one reaches the test position to perform tests. The engaged or "connect position" can be attained only by further insertion with a stronger insertion force. The switch gear can also absorb very strong forces without any further trouble.

SUMMARY OF THE INVENTION

Accordingly, a primary object of the present invention is to provide a connector arrangement in which a pair of test terminal blocks are initially brought into electrical engagement when a pair of support means are displaced from a disconnected condition toward an intermediate test condition, and a pair of main terminal blocks are brought into electrical engagement when the support means are displaced from the intermediate test position toward the final connected condition, one of the test terminal blocks being supported on a carrier member that is displaceable relative to the associated support means, thereby to maintain the test terminal blocks in engagement as the support means are displaced to effect engagement of the main terminal blocks.

According to a more specific object of the invention, friction retaining means serve to maintain the carrier member in one of its first and second positions during the assembly and disassembly of the terminal blocks. The friction retaining means includes a pair of parallel locking levers that are pivoted outwardly by a control member into locking engagement with respective locking recesses contained in the associated support member. The control member is axially displaced relative to a guide sleeve as the main support means are displaced toward one of the test and final engaged conditions.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1B:
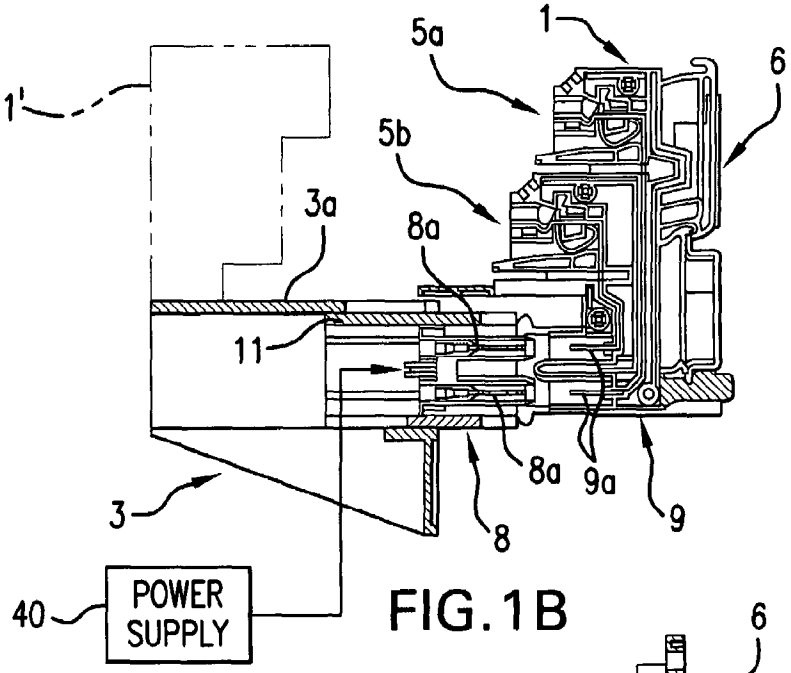
FIGS. 1*b* and 1*c* are corresponding right-hand sectional views of the test connector block arrangement and the frictional retaining means, respectively, of the apparatus of FIG. 1*a;*
Figure 1C:
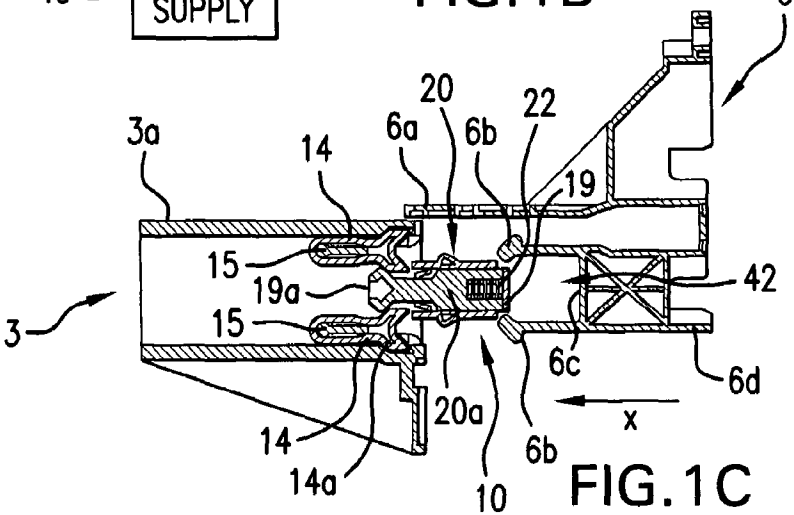
Figure 1A:
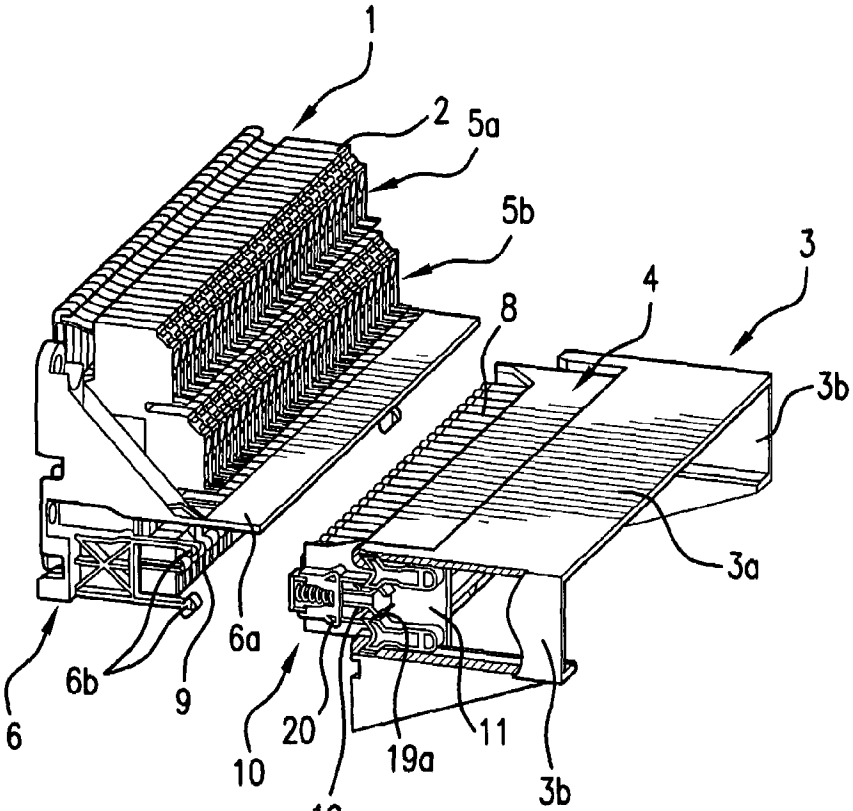
FIG. 1*a* is a perspective left-hand view, with certain parts broken away, of the terminal block connecting apparatus in the initial disconnect condition.

Referring first more particularly to FIGS. 1*a*-1*c*, the connecting apparatus of the present invention is operable to connect a main terminal block assembly 1 electrically with a corresponding main terminal block assembly 1' as shown in FIG. 1*b*. The main terminal block assembly 1 includes a plurality of terminal blocks 2 that are supported by a moveable support means 6 for displacement toward a stationary support means 3 that is connected with a standard electrical installation, system or appliance, not shown. The contacts of the two terminal block assemblies 1 and 1' are of the corresponding pin and socket contact type, whereby displacement of the components together is shown by the arrow x in FIG. 1*c*, effects engagement of the two main block assemblies.

The terminal block assembly 1 includes a pair of parallel rows of contacts 5*a* and 5*b* that are arranged above the horizontal support plate 6*a*. Arranged below the support plate 6*a* is a test terminal block 9 that is adapted for connection with a corresponding test terminal block 8 that is supported by the carrier means 4 for displacement relative to the stationary support means 3. The test terminal block 8 is so supported by the carrier means 4 that as the support means 6 and 3 are brought together as shown by the arrow x in FIG. 1*c*, the contacts 9*a* of the test terminal block 9 carried by the movable support means 6 are brought into electrical engagement with corresponding contacts 8*a* of the test terminal block 8 that is carried by the stationary support means 3.

Figure 2B:
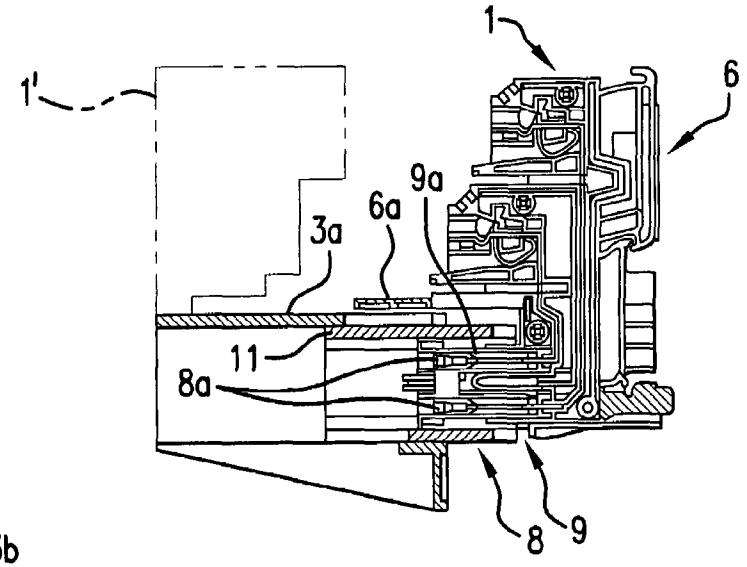
FIGS. 2*b* and 2*c* are corresponding right-hand sectional views of the test connector block arrangement and the friction retaining means, respectively, of the apparatus of FIG. 2*a;*
Figure 2C:
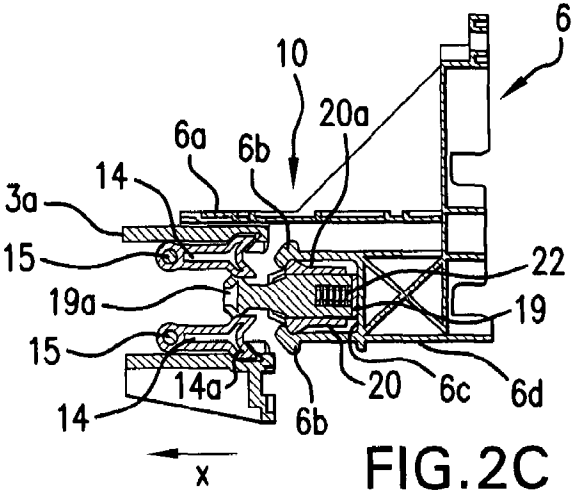
Figure 2A:
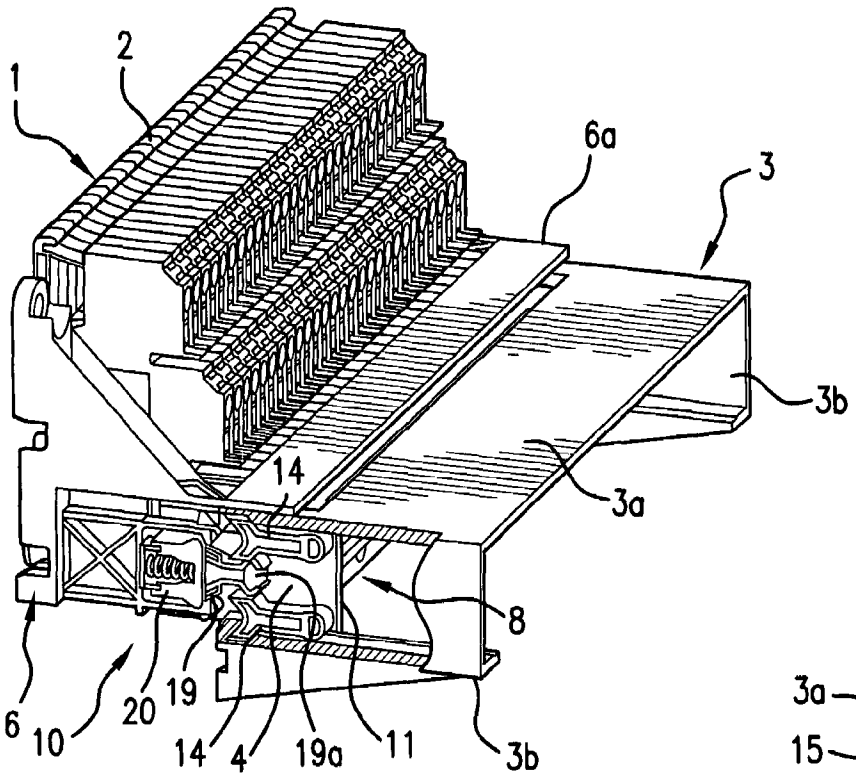
FIG. 2*a* is a left-hand perspective view of the apparatus of FIG. 1*a* when in the intermediate test position.
Figure 3B:
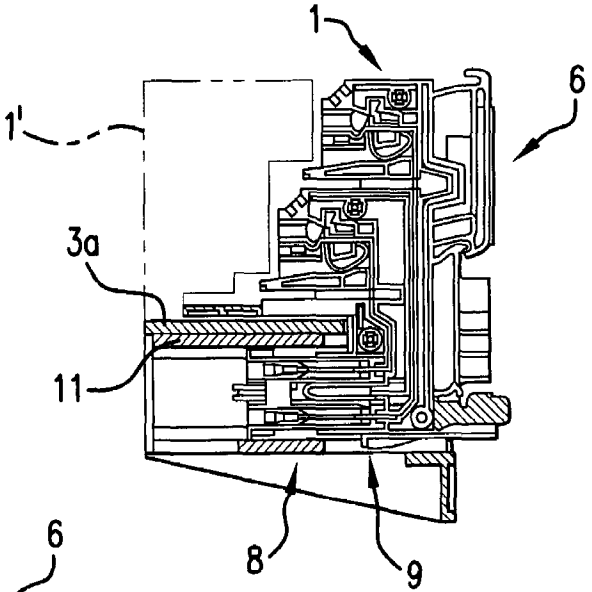
FIGS. 3*b* and 3*c* are right-hand sectional views of the test connector block arrangement and the friction retaining means, respectively, of the apparatus of FIG. 3*a;*
Figure 3C:
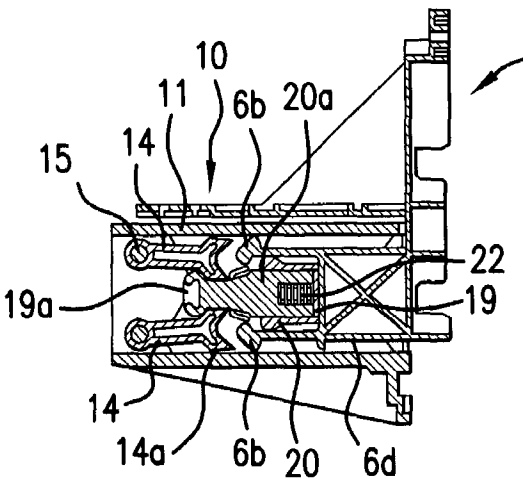
Figure 3A:
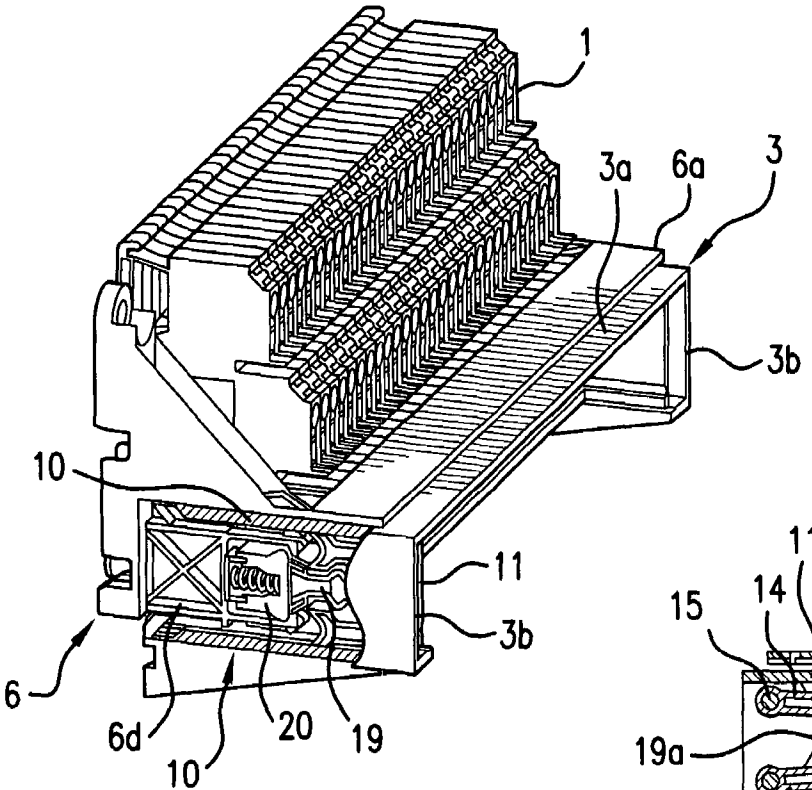
FIG. 3*a* is a left-hand perspective view of the apparatus of FIG. 1*a* when in the fully connected condition.

Upon continued displacement of the movable support means 6 toward the intermediate test position shown in FIGS. 2*a*-2*c*, the test contacts 9*a* are brought into electrical contact with the corresponding test contacts 8*a* of FIG. 2*b*, thereby to energize the test circuitry associated with the test terminal blocks, which circuitry is energized from the power supply 40 of FIG. 1*b*. When the support members 3 and 6 are in this intermediate test position, the electrical contacts of the main terminal blocks 1 and 1' have not yet been brought into electrical contact with each other. Upon further displacement of the moveable support means 6 toward the final contact position of FIGS. 3*a*-3*c*, the contacts of the main terminal assembly 1 are brought into electrical engagement with the corresponding contacts of the associated main terminal block 1', as shown in FIG. 3*b*.

In accordance with a characterizing feature of the present invention, friction retaining means 10 (FIG. 1*a*) are provided for locking the carrier means 4 in one of its end positions of travel. The carrier means 4 includes a generally U-shaped frame 11 (FIG. 6) having a central panel portion 11*a*, and a pair of orthogonally-arranged side walls 11*b*. Similarly, the stationary support means 3 comprises a collar element having a central panel portion 3*a*, and a pair of orthogonally-arranged side walls 3*b*. Guide means 18 support the carrier member 11 for linear displacement in the given direction x relative to the stationary support means 3. When in the assembled condition of FIG. 7, the side walls 11*b* are parallel with and in spaced relation from the corresponding side walls 3*b* of the stationary support member 3, thereby to define a pair of spaces for receiving respectively on of the the friction retaining means 10 of the present invention.

Figure 6:
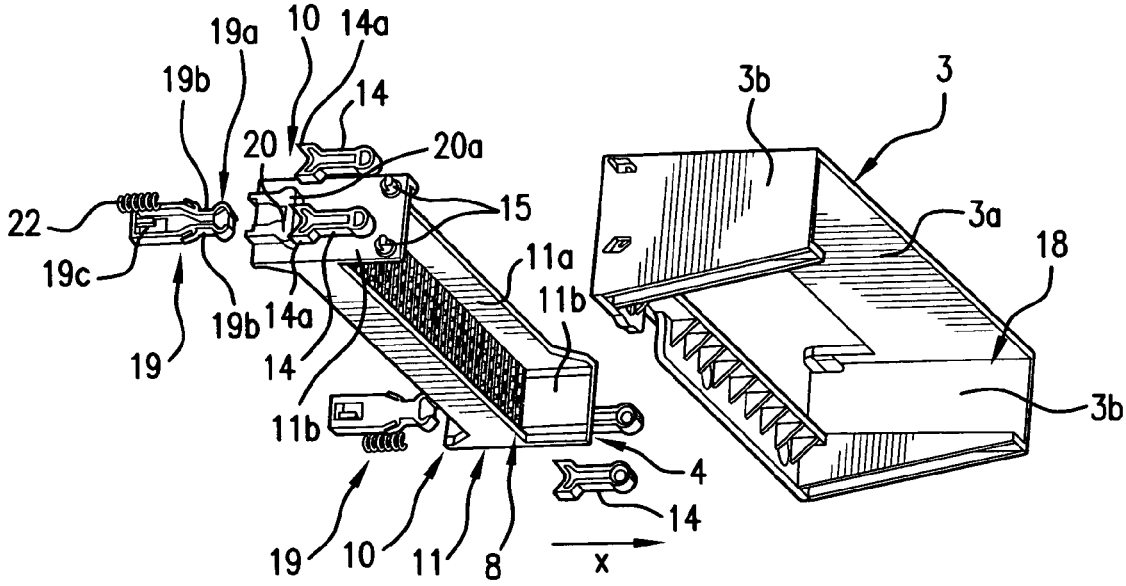
FIG. 6 is an exploded bottom perspective view of the carrier means that support the friction retaining means of FIG. 1*a*.
Figure 7:
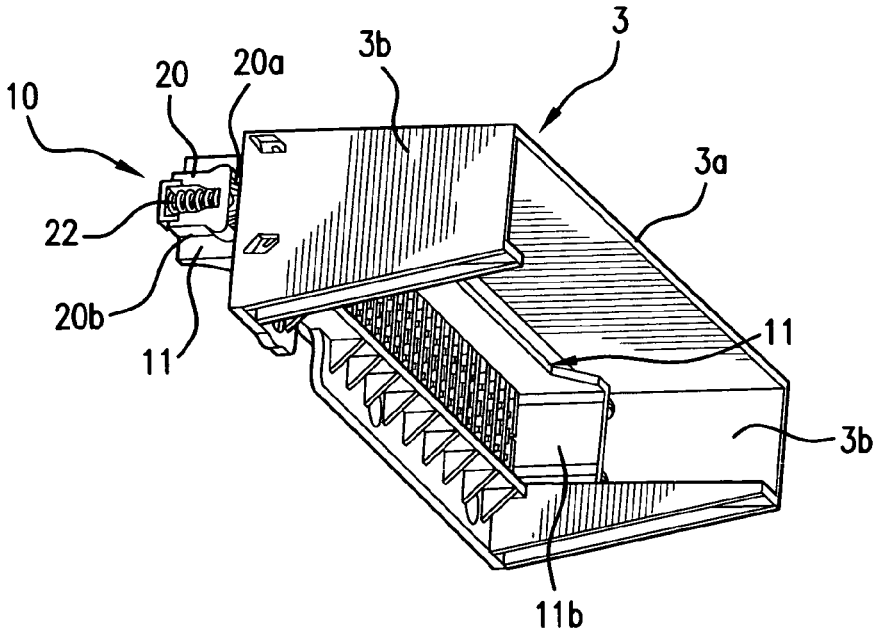
FIG. 7 illustrates the apparatus of FIG. 6 when in the assembled condition.
Figure 10A:
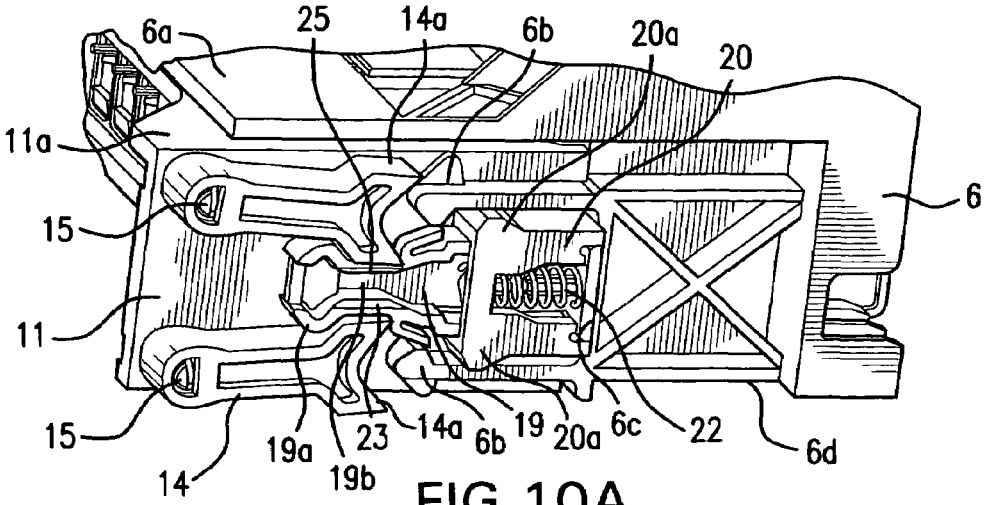
FIG. 10*a* is a detailed perspective view of the friction retaining means of FIG. 1, and FIGS. 10*b* and 10*c* are perspective and side views, respectively, of a modification of the friction retaining means of FIG. 10*a*.

As best shown in FIGS. 6 and 10*a*, the friction retaining means 10 includes a pair of locking levers 14 that are pivotally connected at one end by pivot pins 15 with the outer surface of one side wall 11*b* of the carrier member 11. The other ends 14*a* of the locking levers are bifurcated to define a pair of outwardly directed detent portions. Arranged between the locking levers 14 is a control member 19 that is supported for axial displacement in a direction parallel with said given direction x. The opposed sides at one end of the control member 9 contain a pair of recesses 23 that cooperate to define an enlarged head portion 19*a* that is joined with the body portion of the control member by a neck portion 19*b*. The enlarged head portion 19*a* engages the adjacent surfaces of the inner detent portions at the bifurcated ends 14*a* of the two locking levers 14, as shown in FIG. 10*a*. The control member 19 is slidably displaceable within a through bore contained in a guide sleeve member 20 that is fastened to the outer surface of a side wall 11*b* of the carrier member 11.

Figure 4:
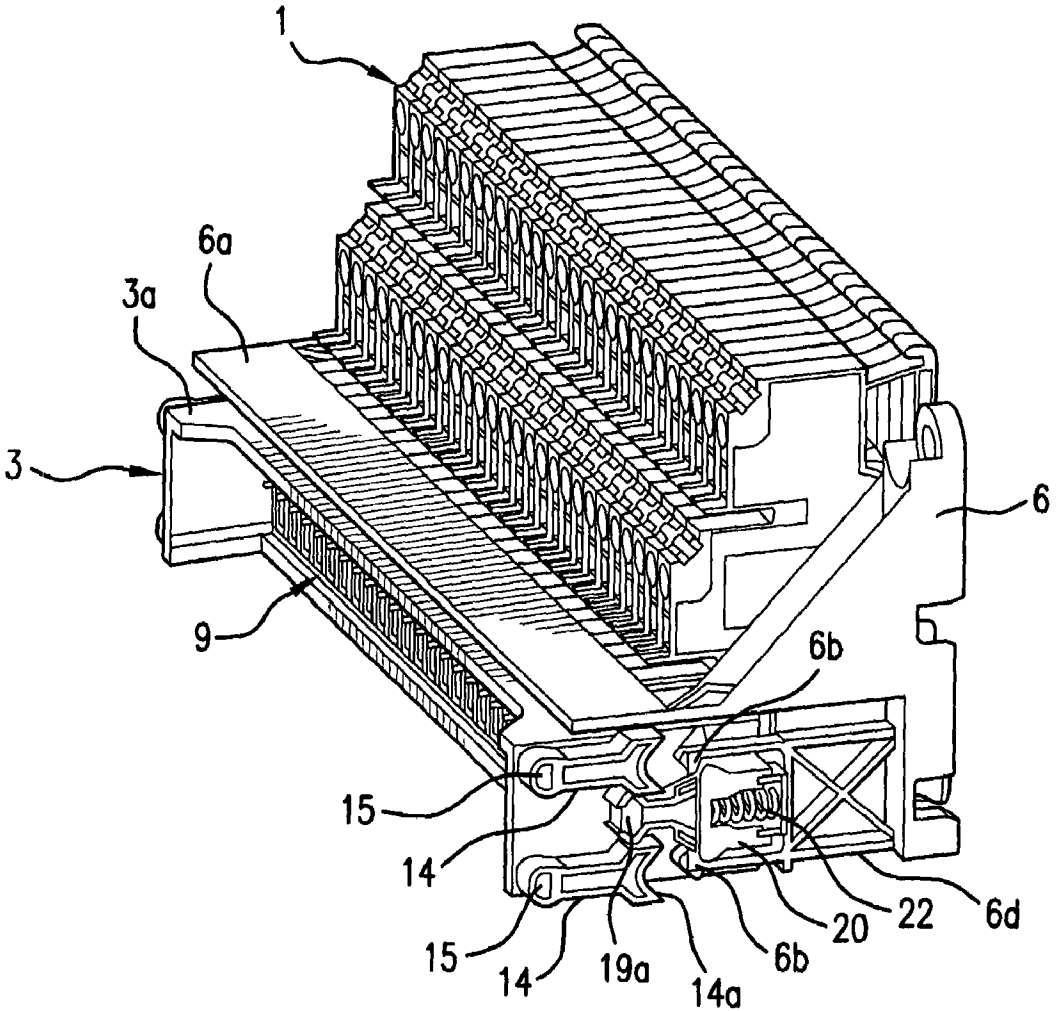
FIG. 4 is a right-hand perspective view of the apparatus of FIG. 2*a;*
Figure 5:
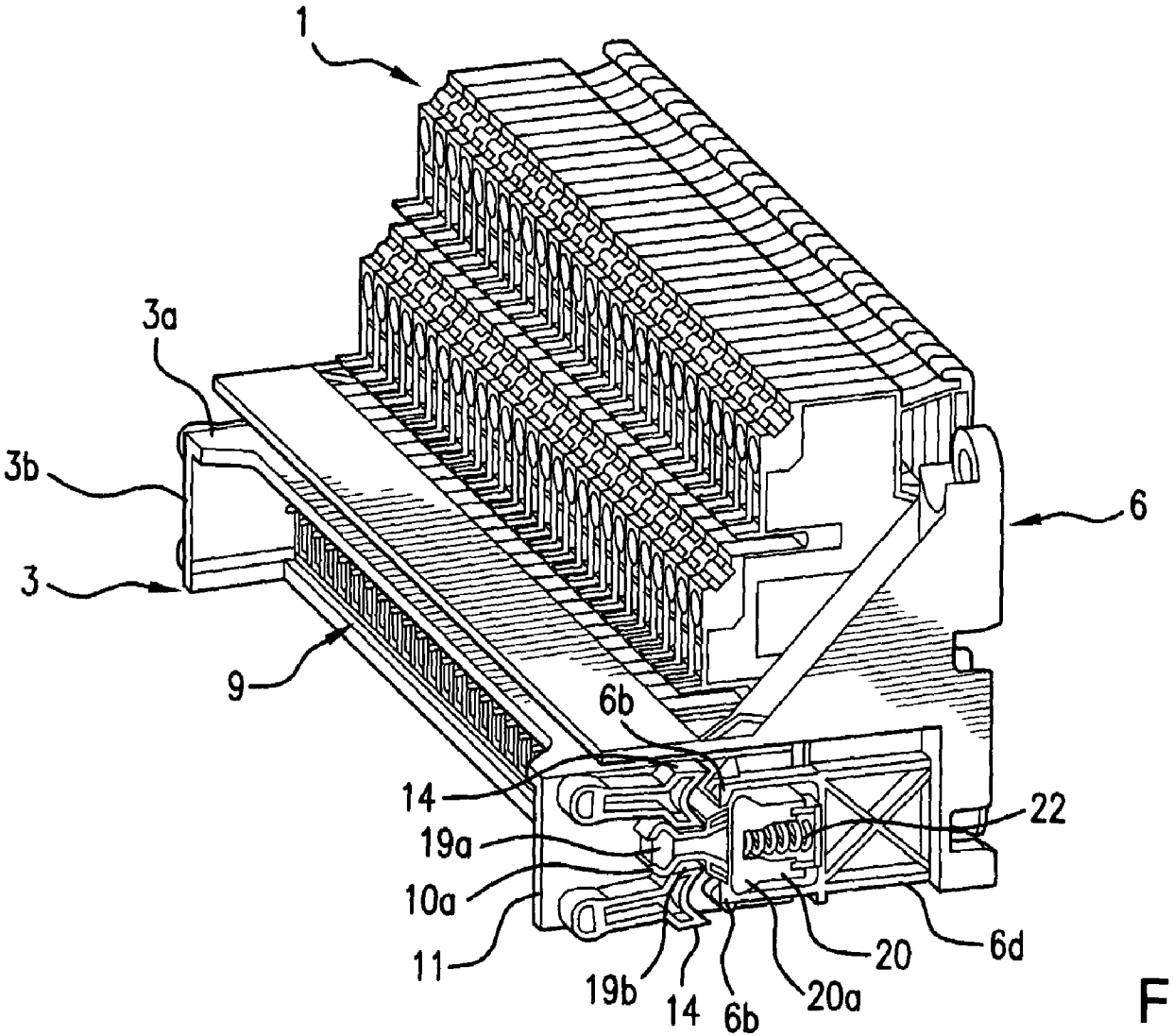
FIG. 5 is a right-hand perspective view of the apparatus of FIG. 3*a;*

Referring again to FIGS. 1*a*-1*c*, the moveable support means 6, which may be formed of metal or a suitable synthetic plastic material, includes a pair of parallel spaced resilient arm portions 6*b* that extend toward the stationary support means 3. The support arms 6*b* are provided at their free extremities with hook-like extensions, and cooperate with the transverse wall portion 6*c* of the integral base portion 6*d* of the movable support means 6 to define a chamber 42 for receiving the guide sleeve 20 associated with the control member 19. Compression spring 22 is mounted within a bore contained in the base of the body portion of the control member 19 for reaction with the transverse wall 6*c*, as will described in greater detail below. Thus, when the moveable support means 6 is displaced toward the stationary support means 3 in the direction illustrated by the arrow x in FIG. 2*c*, the resilient arm portion 6*b* of the support member 6 engage external projections 20*a* contained on the outer surface of the guide member 20, thereby to connect by a snap fit the support member 6 into engagement with the shoulder portions 20*a* on the outer surfaces of the guide sleeves 20 that are fastened to the side walls 11 of the carrier member 11. As shown in FIG. 2*c*, the compression spring 22 cooperates with the transverse wall 6*c* to bias the control member 19 to the left toward the stop position defined by the guide sleeve 20, as shown in FIG. 2*c*. As shown in FIG. 2*b*, the pin and socket contacts 9*a* and 8*b* of the two test terminal blocks are now in engagement to control test circuits supplied with power from the power supply 40. Upon further displacement of the moveable support means 6 toward the final connected position of FIGS. 3*a*-3*c*, the extremities of the resilient arm portion 6*b* engage the bifurcated ends 14*a* of the locking levers 14, thereby to pivot the same inwardly toward the unlocked position shown in FIG. 3*c*. As shown in FIG. 3*b*, the carrier member 11 is displaced in such a manner as to maintain the contacts of the two test terminal blocks 8 and 9 in continued engagement as the main terminal blocks 1 and 1' are displaced toward the connected condition of FIG. 3*b*. FIG. 4 illustrates the apparatus when in the test condition of FIGS. 2*a*-2*c*, and FIG. 5 illustrates the apparatus when in the finally assembled contact position of FIG. 3*a*-3*c*.

Figure 8A:
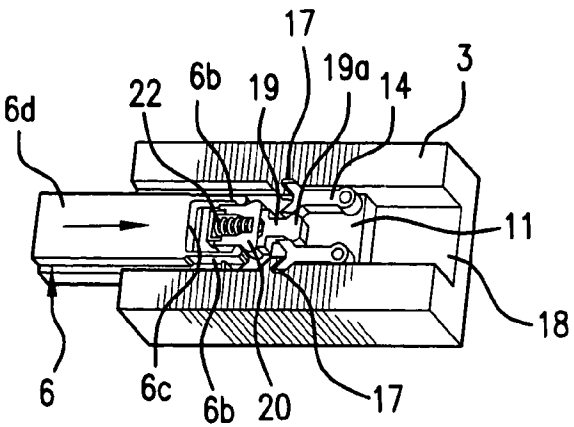
FIGS. 8*a*-8*f* are schematic views illustrating the operation of the friction retaining means of FIG. 6.
Figure 8B:
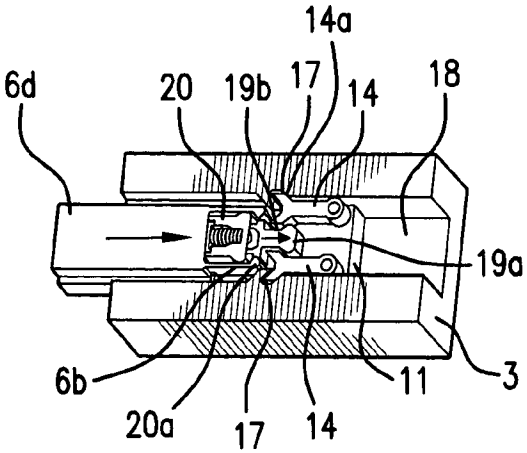
Figure 8C:
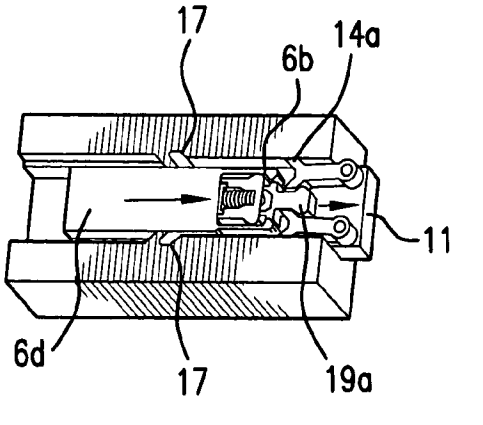
Figure 8E:
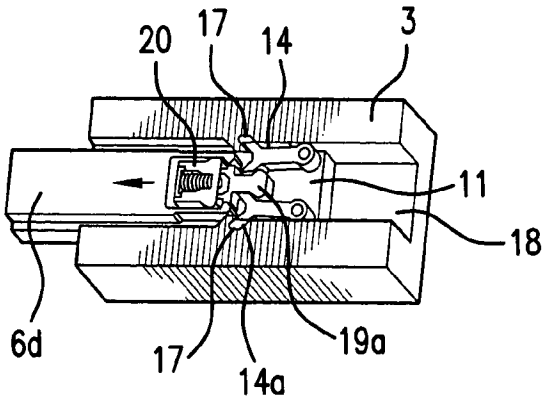
Figure 8F:
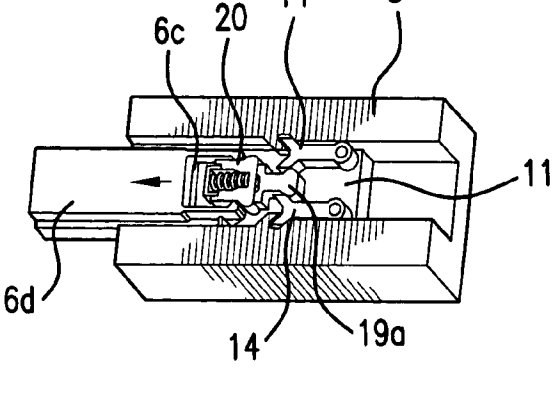

Referring now to FIGS. 8*a*-8*f*, the operation of the friction retaining means 10 is illustrated schematically. More particularly, as shown in FIG. 8*a*, when the moveable support member 6 is displaced toward the stationary support member 3, the resilient actuating arms 6*b* are shifted to the right over the lateral projections 20*a* on the side walls of the guide sleeve 20, whereupon the bottom wall 6*c* of the recess 42 engages the spring 22 mounted in a bore contained at the lower extremity of the control member 19. As the actuating portion 6*d* is shifted to the right in FIG. 8*b*, the locking levers 14 are pivoted inwardly to remove the outer detents from the locking recesses 17 contained in the stationary guide member 3. Thus, the carrier member 11 is released for travel to the second position illustrated in FIG. 8*c*, which is the final connected position in which the main terminal blocks 1 and 1' are electrically connected as shown in FIG. 3*b*.

Figure 8D:
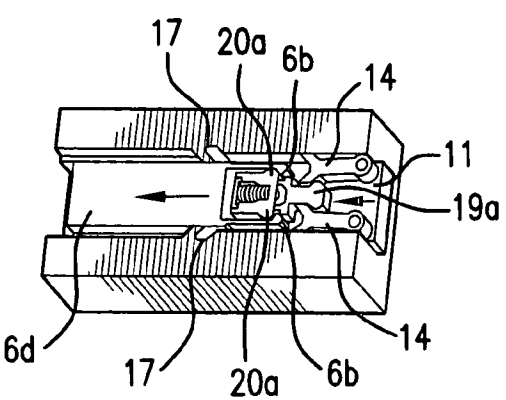

To disconnect the main terminal blocks 1 and 1', the moveable element 6 is displaced in the opposite direction as shown by the arrow in FIG. 8*d*, whereupon the hook portions at the ends of the resilient actuating arms 8*b* engage the shoulder surface of the guide sleeve 20, thereby to initiate displacement of the carrier member 11 to the left. When the outer detents on the locking levers reach the locking recesses 17, the levers are separated by the enlarge head portion 19*a* of the control member, thereby to lock the levers 14 to the recesses 17. Upon further displacement of the operating member 6*d* to the left, the enlarged head portion 19*a* of the control member is wedged into frictional engagement with the inner detents at the bifurcated end portions of the locking levers. If desired, the member 6*d* can be further displaced to the left to totally disengage the member 6 from the support member 3, whereby the components are in the initial disengaged condition of FIGS. 1*a*-1*c*.

Figure 9B:
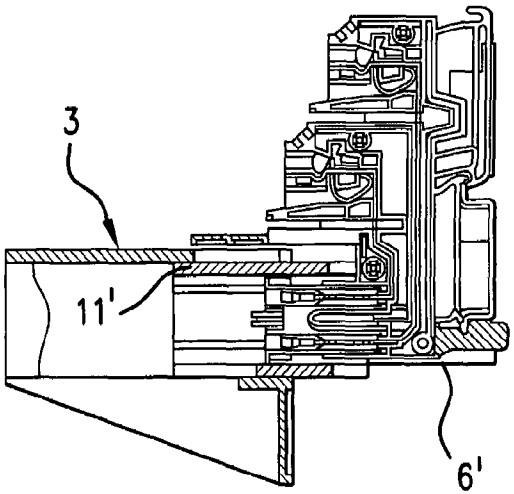
FIGS. 9*b* and 9*c* are sectional and detailed sectional views, respectively, of the apparatus of FIG. 9A.
Figure 9C:
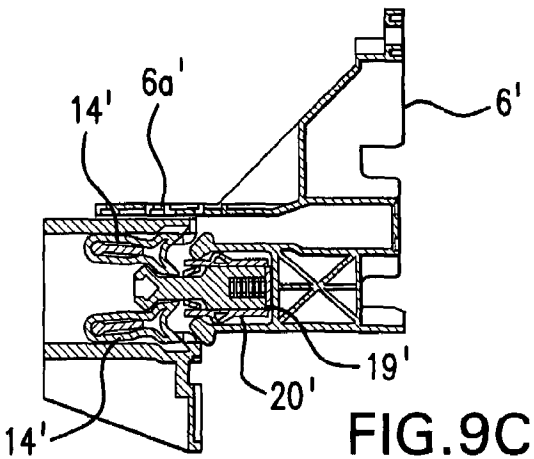
Figure 9A:
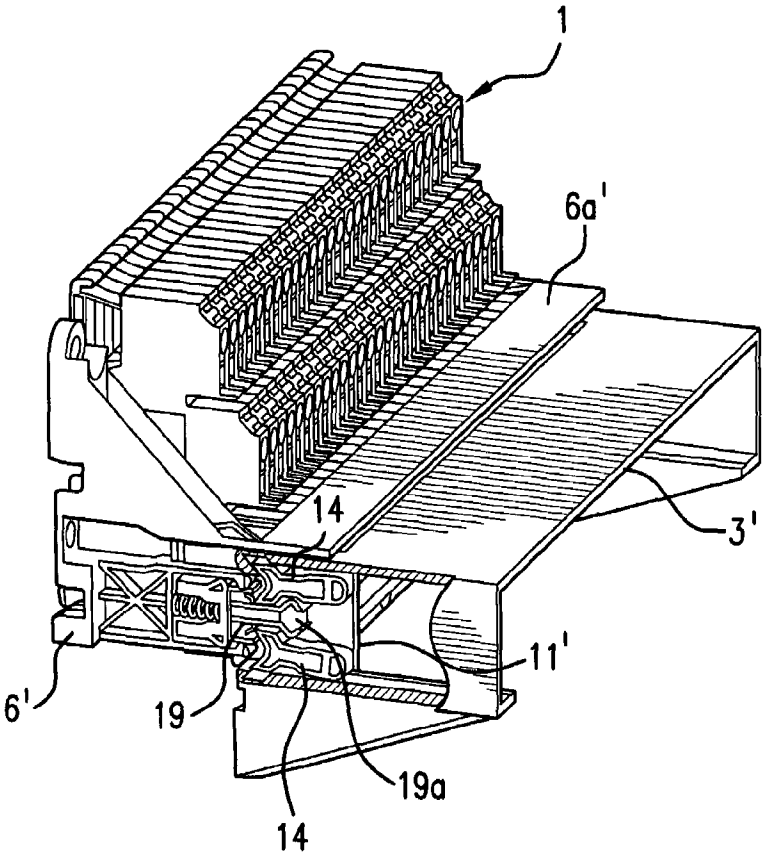
FIG. 9*a* is a left hand perspective view of a modification of the apparatus of FIG. 2*a* when in the test condition.

In the modified embodiment of FIGS. 9*a*-9*c*, the design is such that the control member 19 in the test position is already inserted so far that its head portion 19*a* no longer precisely engages between the inner detent portions of the locking levers 14. This locking position is thus, so to speak, left again for the attainment of the test position according to FIG. 2, which offers the advantage that the mechanical components in the test position are further relieved of forces when the test position is retained, for example, for a longer period of time.

Figure 10B:
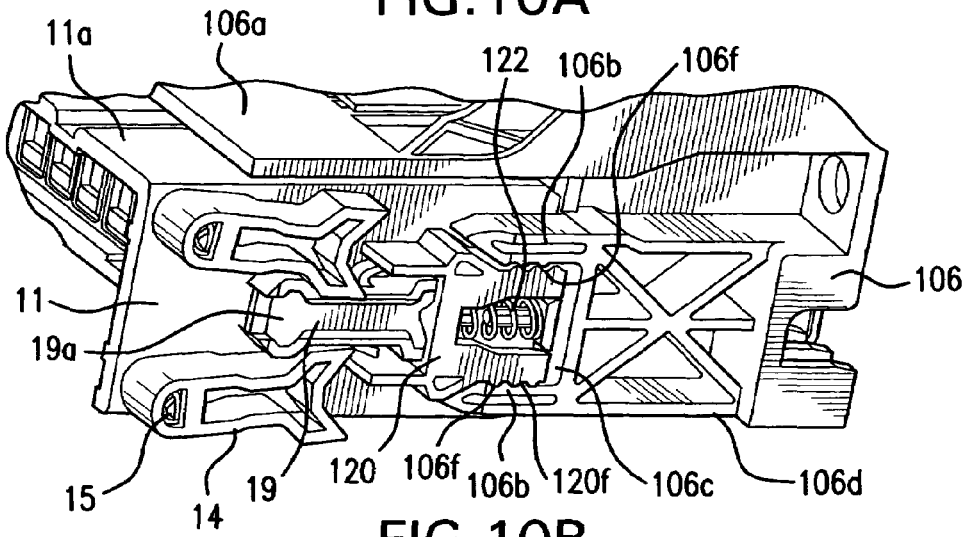
Figure 10C:
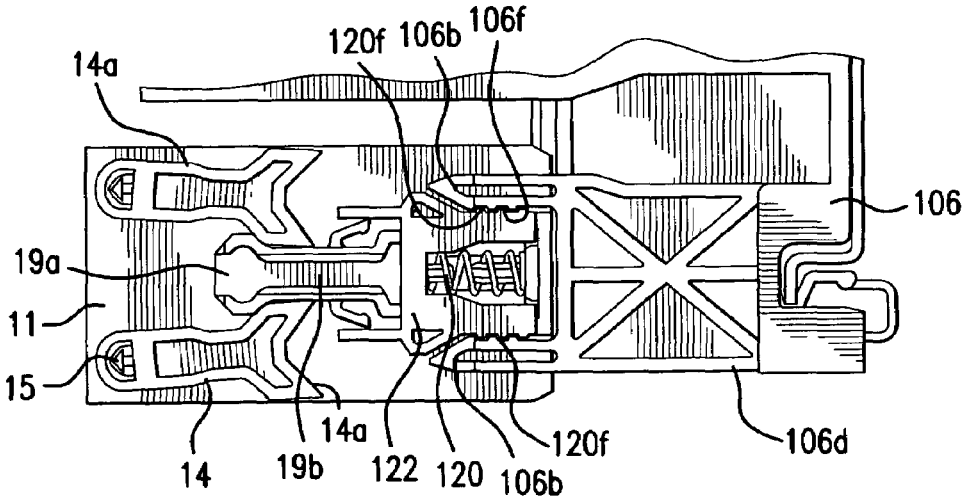

Referring now to the modification of FIGS. 10*b* and 10*c*, the resilient arm portions 106*b* of the moveable support member 106 are provided with ribbed inner surfaces 106*f* on the resilient arm portions 106*b* that engage corresponding external rib surfaces 120*f* on the outer surface guide sleeve 120. This design is particularly stable and thus insensitive to variations in force.

Of course, it is contemplated that the elements might be reversed so that the friction retaining means are mounted on the stationary support means 3 rather that the moveable support means 6.

While in accordance with the provisions of the Patent Statutes the preferred forms and embodiments of the invention have been illustrated and described, it will be apparent to those skilled in the art that changes may be made without deviating from the invention described above.

What is claimed is:

1. Terminal block connecting apparatus for electrically connecting a pair of main terminal block assemblies (1, 1') having corresponding pin and socket contacts, comprising:

(a) first support means (6) supporting a first terminal block assembly (1);

(b) second support means (3) supporting a second main terminal block assembly (1'), said first and second support means being relatively linearly displaceable in a given direction (x) between successive disconnected, intermediate, and connected positions, the contacts of said first and second main terminal blocks being in engagement when said first and second support means are in said connected condition, said second support means including a second support member (3) including a central wall portion (3*a*), and a pair of orthogonally arranged parallel side wall portions (3*b*);

(c) a first test terminal block (9) rigidly connected with a first one of said first and second support means;

(d) a second test terminal block (8), said first and second test terminal blocks having corresponding pin and socket contacts;

(e) carrier means (4) supporting said second test terminal block at a first position on the other of said first and second support means for engagement with said first test terminal block when said first and second support means are in said test position, said carrier means being operable to displace said second test terminal block toward a second position relative to said other support means when said first and second support means are displaced between said test and connected conditions, said first and second test terminal blocks being maintained in electrical engagement during the displacement of said second test terminal block to said second position, said carrier means including a carrier member (11) having a central wall portion (11*a*) and a pair of side wall portions (11*b*), said carrier member being arranged for sliding displacement in said given direction within said second support member with the corresponding central walls being parallel and adjacent each other, and with the correspond side walls being parallel and spaced from each other; and (f) a pair of friction retaining means (10) normally resisting movement of said carrier means from one of said first and second positions, said friction retaining means being respectively arranged in the spaces defined between corresponding pairs of said spaced side walls, each of said friction retaining means comprising:

(1) a pair of generally parallel spaced locking levers (14) arranged adjacent the outer surface of the associated carrier member side wall and extending in a direction generally parallel with said given direction adjacent opposite sides of said carrier member side wall, said levers having first ends pivotally connected (15) with the associated carrier member side wall, and second ends (l4*a*) that are bifurcated to define a pair or outwardly divergent outer and inner detent portions;

(2) said locking levers being arranged for relative outward pivotal separation from a contracted adjacent released condition toward an expanded locked condition in which an outer detent portion of each lever is in locking engagement with a corresponding recess contained in said second support member.

2. Terminal block connecting apparatus as defined in claim 1, wherein said friction retaining means is operable to resist movement of said carrier means from said first position.

3. Terminal block connecting apparatus as defined in claim 1, wherein said friction retaining means is operable to resist movement of said carrier means from said second position.

4. Terminal block connecting apparatus as defined in claim 1, wherein said friction retaining means further includes:

(3) a control member (19) arranged between said levers for longitudinal displacement in said given direction between a locking position in which said levers are locked in their locked condition, and an unlocking position in which said levers are released from said locking recesses.

5. Terminal block connecting apparatus as defined in claim 4, wherein said friction retaining means further includes:

(4) guide means operable when said first and second support means are in said intermediate test position to support said control member for sliding displacement in said given direction relative to said carrier member, said guide means including:

(a) means defining a guide recess (42) contained in said first support means; and (b) a support sleeve (20) mounted for sliding displacement in said given direction in said guide recess, said support sleeve containing a longitudinal through bore in which said control member is slidably mounted.

6. Terminal block connecting means as defined in claim 5, wherein said friction retaining means further includes:

(5) compression spring means (22) arranged in said recess for biasing said control member toward said releasing position.

7. Terminal block connecting apparatus as defined in claim 6, wherein said control member (19) contains at one end a pair of lateral recesses (23) that define on said control member an enlarged head portion (19*a*) joined to the control member body portion by a neck portion (19*b*), said locking lever inner detent portions extending into said recesses.

8. Terminal block connecting apparatus as defined in claim 7, wherein said first support means (6) includes actuating means (6*b*) for displacing said control member toward said releasing position when said first and second support means are in said intermediate test position.

9. Terminal block connecting apparatus as defined in claim 8, wherein said actuating means is operable to displace said carrier member toward said second position when said first and second support means are displaced toward said connected condition.

10. Terminal block connecting apparatus as defined in claim 9, wherein said actuating means comprises a pair of parallel spaced resilient arm portions (6*b*) extending from said first support means in said given direction for engagement with the bifurcated end portions of said locking levers.

11. Terminal block connecting apparatus as defined in claim 10, wherein said arm portions terminate at their free extremities in inwardly directed hook portions, said hook portions being operable to displace said control member toward said locking position when said first and second support means are displaced from said connected position toward said intermediate test position.

12. Terminal block connecting apparatus as defined in claim 10, wherein said actuating means arm portions include at their free extremities inwardly directed ribbed portions (106*f*) arranged for engagement with corresponding ribbed portions on the outer surfaces (120*f*) of said guide sleeve.

* * * * *